United States Patent [19]

Kawamura

[11] Patent Number: 5,009,202

[45] Date of Patent: Apr. 23, 1991

[54] ELECTROMAGNETICALLY OPERATED VALVE ASSEMBLY FOR USE IN INTERNAL COMBUSTION ENGINE

[75] Inventor: Hideo Kawamura, Samukawa, Japan

[73] Assignee: Isuzu Motors Limited, Tokyo, Japan

[21] Appl. No.: 452,041

[22] Filed: Dec. 18, 1989

[30] Foreign Application Priority Data

Dec. 22, 1988 [JP] Japan ..... 63-324301

[51] Int. Cl.[5] ..... F01L 9/04

[52] U.S. Cl. ..... 123/90.11; 251/129.1

[58] Field of Search ..... 123/90.11; 251/129.05, 251/129.09, 129.1

[56] References Cited

U.S. PATENT DOCUMENTS

| | | | |
|---|---|---|---|
| 1,460,517 | 7/1923 | Stevens | 335/261 |
| 3,223,802 | 12/1965 | Horst | 335/267 |
| 4,378,766 | 4/1983 | Yamazoe et al. | 251/129.05 X |
| 4,938,179 | 7/1990 | Kawamura | 123/90.11 |

FOREIGN PATENT DOCUMENTS

| | | |
|---|---|---|
| 61705 | 3/1988 | Japan . |
| 301444 | 11/1928 | United Kingdom . |
| 568216 | 3/1945 | United Kingdom . |
| 580451 | 9/1946 | United Kingdom . |

*Primary Examiner*—Tony M. Argenbright
*Attorney, Agent, or Firm*—Staas & Halsey

[57] ABSTRACT

An electromagnetically operated valve assembly for use in an internal combustion engine includes a valve, serving as an intake or exhaust valve, made of a ceramic material for reduced weight and good response in operation. The valve assembly also includes an electromagnetic actuator comprising a movable member mounted on the upper end of the valve stem of the valve and having a frustoconical flange portion on an end thereof, and a fixed member disposed above the movable member in confronting relation thereto and having a recessed portion complementary in shape to the frustoconical flange portion. With this arrangement, while the valve is made of a nonmagnetic ceramic material, a sufficient magnetic path cross-sectional area is maintained through the movable member without increasing the size of the movable member.

2 Claims, 2 Drawing Sheets

ELECTROMAGNETICALLY OPERATED VALVE ASSEMBLY FOR USE IN INTERNAL COMBUSTION ENGINE

BACKGROUND OF THE INVENTION

The present invention relates to an electromagnetically operated valve assembly for selectively opening and closing an intake or exhaust port of an internal combustion engine under electromagnetic forces.

Intake and exhaust valves for selectively opening and closing the intake and exhaust ports of an internal combustion engine are generally operated by a valve operating mechanism which is actuated by cams on a camshaft.

Electromagnetic valve control systems for controlling the timing of operation of the intake and exhaust valves of internal combustion engines through an electromagnetic actuator means are disclosed in Japanese Laid-Open Patent Publication Nos. 58(1983)-183805 and 61(1986)-76713. These prior electromagnetic valve control systems are however not addressed to an improvement in intake and exhaust valves. The intake and exhaust valves used in the known electromagnetic valve control systems are problematic in that since the valves are made of metal, they are heavy, poor in response, and require large driving forces.

A valve made of a ceramic material is light and suitable to perform required valve functions. However, the ceramic material presents a large magnetic reluctance as it is nonmagnetic. Accordingly, the electromagnetic actuator means for use with the ceramic valve is required to have an increased magnetic path cross-sectional area. As a result, the movable member of the electromagnetic actuator means is heavy, and the same problems as those of the above conventional valves still remain to be solved.

SUMMARY OF THE INVENTION

It is an object of the present invention to provide an electromagnetically operated valve assembly for use in an internal combustion engine, which valve assembly includes a valve, serving as an intake or exhaust valve for selectively opening an intake or exhaust port in the engine, and a movable member to be movable by an electromagnetic actuator means, the valve and the movable member being light so that the valve can be operated with a good response by the electromagnetic actuator means.

According to the present invention, there is provided an electromagnetically operated valve assembly for selectively opening and closing a port communicating with a cylinder in an internal combustion engine, comprising a valve made of a ceramic material, for selectively opening and closing the port, the valve including a stem, a movable member mounted on an end of the stem and having a frustoconical flange portion on an end thereof, the movable member being made of a magnetic material, a first coil disposed around the movable member, a fixed member disposed in confronting relation to the movable member and having a recessed portion complementary in shape to the frustoconical flange portion, the fixed member being made of a magnetic material, and a second coil disposed around the fixed member.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
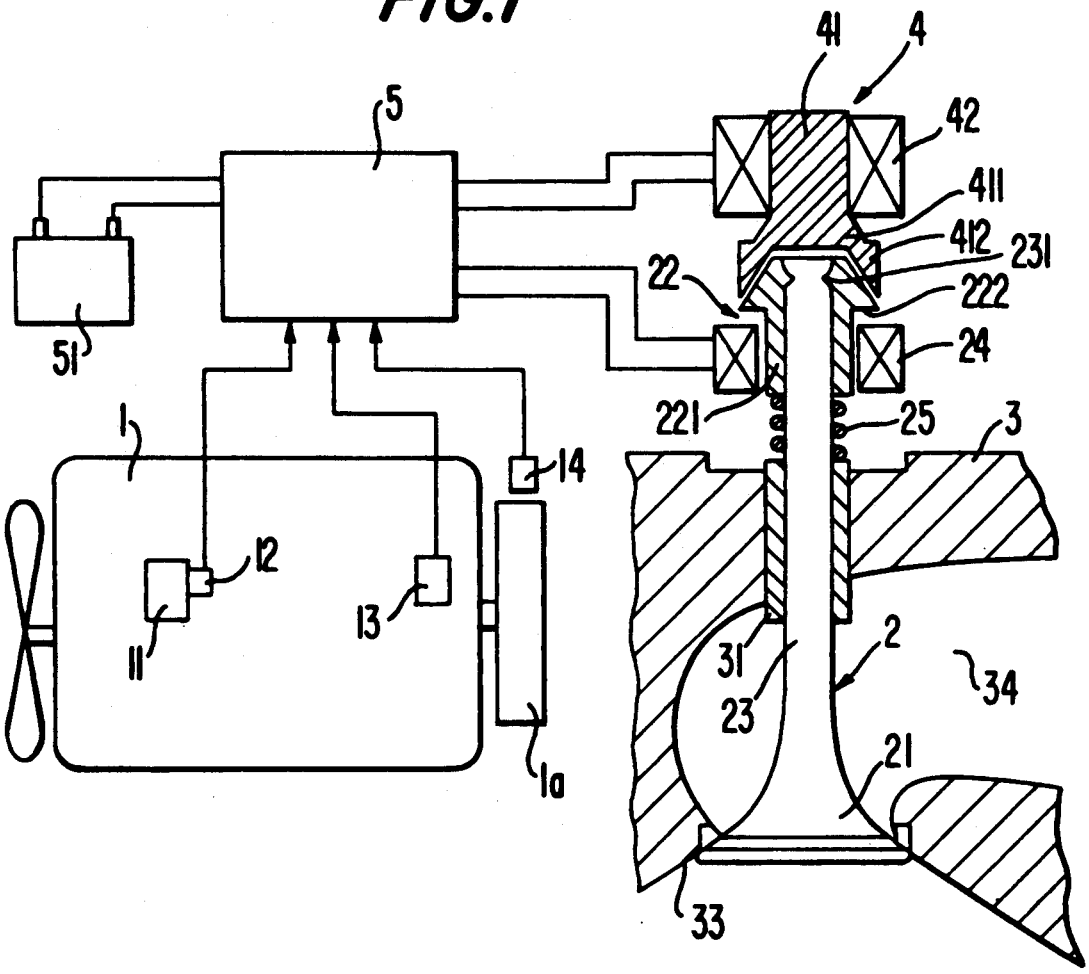
FIG. 1 is a block diagram, partly in cross section, of a valve control system including an electromagnetically operated valve assembly for use in an internal combustion engine according to the present invention.

FIG. 1 shows a valve control system incorporating an electromagnetically operated valve assembly for use in an internal combustion engine according to the present invention.

As shown in FIG. 1, an internal combustion engine 1 is mounted on a motor vehicle (not shown) for driving the motor vehicle. The internal combustion engine 1 is supplied with fuel from a fuel supply unit 11 such as a fuel injection pump. The amount of fuel supplied to the internal combustion engine 1 by the fuel supply unit 11 is detected by an engine load sensor 12, which applies a detected signal to a controller 5. The top dead center of the piston in each of the cylinders of the internal combustion engine 1 and the angular position of the crankshaft of the engine 1 are detected by a crankshaft angle sensor 13. An engine speed sensor 14 for detecting the rotational speed of the engine 1 is positioned in confronting relation to a flywheel 1*a* of the engine 1. Detected signals from the sensors 13, 14 are also sent to the controller 5.

A intake valve 2 for selectively opening and closing an intake port 34 communicating with each cylinder of the internal combustion engine 1 is made of a ceramic material such as silicon nitride, silicon carbide, or the like. The intake valve 2 is slidably fitted in a valve guide sleeve 31 mounted in a cylinder head 3 and made of a ceramic material such as silicon nitride, silicon carbide, or the like. The intake valve 2 includes a valve head 21 which can be seated on and unseated from a valve seat 33 to open and close the intake port 34 for thereby controlling the stream of air flowing into the engine cylinder. A movable member 22 of a ferromagnetic material such as soft steel is fixedly fitted over the upper end of the stem 23 of the intake valve 2. The movable member 22 comprises a hollow cylindrical portion 221 and a frustoconical flange portion 222 on the upper end of the hollow cylindrical portion 221. The movable member 22 may be secured to the valve stem 23 in the manner disclosed in Japanese Laid-Open Patent Publication No. 60(1985)-92025, for example. More specifically, the movable member 22 is fitted over the upper end of the valve stem 23, and then the end upper of the movable member 22 is compressed to deform a portion of the movable member 22 into a groove 231 defined in and around the upper end of the valve stem 23. While the valve stem 23 of ceramic is disposed centrally in the movable member 22, the frustoconical flange portion 222 on the hollow cylindrical portion 221 prevents the magnetic reluctance acting against magnetic fluxes to drive the valve 2 from being increased, and the hollow cylindrical portion 221 provides a magnetic path having a sufficient cross-sectional area.

A lower coil 24 is disposed around the movable member 22. When the lower coil 24 is energized, it magnetically moves the movable member 22 in the axial direction of the intake valve 2. An electromagnet 4 is disposed above the movable member 22 in confronting relation thereto. The electromagnet 4 comprises a fixed member 41 made of a ferromagnetic material such as soft steel and an upper coil 42 fixed to and disposed around the fixed member 41. The fixed member 41 comprises a solid cylindrical portion 411 and a recessed portion 412 disposed on the lower end of the solid cylindrical portion 411 in confronting relation to the frustoconical flange portion 222, the recessed portion 412 having a recess complementary in shape to the flange portion 222. The movable member 22, the lower coil 24, the fixed member 41, and the upper coil 42 jointly serve as an electromagnetic actuator means for electromagnetically actuating the intake valve 2. By supplying electric power from a battery 51 to the coils 24, 42 and controlling the polarity and voltage of the supplied electric power, the electromagnetic actuator means controls the opening and closing of the intake valve 2 and the intensity of forces to open and close the intake valve 2. A coil spring 25 is disposed around the valve stem 23 between the movable member 22 and the valve guide sleeve 31 for normally urging the intake valve 2 to close the intake port 34 and prevent the intake valve 2 from dropping when the coils 24, 42 are de-energized.

The movable member 22 and the fixed member 41 will be described in greater detail with reference to FIG. 2. The frustoconical flange portion 222 of the movable member 22 has its tapered outer surface composed of a plurality of successive steps 223. The recess of the recesses portion 412 also has its tapered inner surface composed of a plurality of successive steps 413 complementary to the steps 223. When the movable member 22 is magnetically attracted to the fixed member 41, these steps 223, 413 are closely held against each other in interfitting relation. Therefore, the magnetic path through which magnetic fluxes pass when the intake valve 2 is operated has a wider cross-sectional area through these steps 223, 413 than possible with magnetic poles of a conventional design which face each other flatwise across the direction in which the valve operates, as shown in FIG. 3. The movable member 22 can thus be strongly attracted to and repelled from the fixed member 41 under electromagnetic forces.

Figure 2:
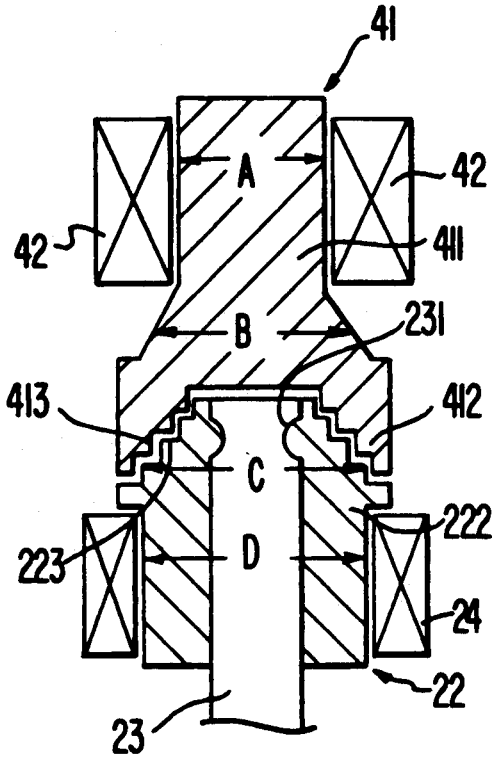
FIG. 2 is an enlarged cross-sectional view of the electromagnetically operated valve assembly shown in FIG. 1.
Figure 3:
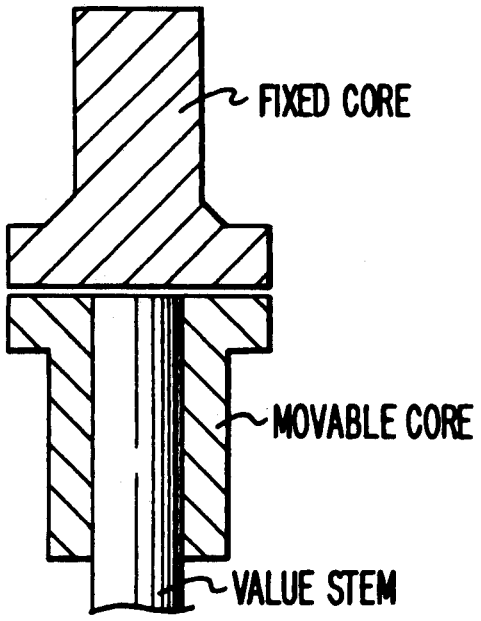
FIG. 3 (PRIOR ART)
FIG. 3 is a cross-sectional view of magnetic pole portions of a conventional electromagnetically operated valve assembly.

As shown in FIG. 2, the solid cylindrical portion 411 has a magnetic path cross-sectional area A, the recessed portion 412 has a magnetic path cross-sectional area B, the frustoconical flange portion 222 has a magnetic path cross-sectional area C, and the hollow cylindrical portion D has a magnetic path cross-sectional area D. The cross-sectional areas B, C, D are equal to or larger than the cross-sectional area A. In particularly, the movable member 22 is constructed such that its magnetic path cross-sectional area is not reduced by the nonmagnetic valve stem 23, thus reducing the magnetic reluctance of the magnetic path through which the magnetic fluxes for operating the valve flow.

In the above embodiment, only the intake valve 2 has been described. However, an exhaust valve may be identically constructed and operated except that its timing of opening and closing the exhaust port is different from that of the intake valve. Therefore, the electromagnetically operated valve assembly of the invention is equally applicable to the intake and exhaust valves.

The controller 5 comprises a microcomputer which includes a central processing unit for effecting various arithmetic operations based on a control program, memories for storing the control program, various data, etc., and an input/output interface. When the controller 5 is supplied with signals from the sensors 12, 13, 15, the controller 5 processes the supplied signals according to the control program, controls the polarity and voltage of electric power from the battery 51, and supplies the controlled electric power to the coils 24, 42 which electromagnetically control the intake valve 2 to open or close the exhaust port 34.

The battery 51 also supplies electric power to energize the controller 5 as well a the coils 24, 42.

Operation of the valve control system will be described below.

Based on the signals from the crankshaft angle sensor 13 and the engine speed sensor 4, the controller 5 retrieves corresponding data from the memory to read the timing to open and close the intake valve 2 corresponding to the supplied signals. The controller 5 then supplies currents based on the read timing to the coils 24, 42. The energized coils 42, 24 magnetize the recessed portion 412 and the flange portion 222, respectively. If the recessed portion 412 and the flange portion 222 ar magnetized into different magnetic polarities, then the movable member 22 is attracted to the fixed member 41 under magnetic fluxes passing through the steps 413, 223 which provide a wide magnetic cross-sectional area. Therefore, the intake valve 2 is moved upwardly to close the intake port 34.

The recessed portion 412 and the flange portion 222 are magnetized into the same polarity by supplying currents of different polarities to the coils 42, 24. At this time, the movable member 22 is repelled from the fixed member 41, thus moving the intake valve 2 downwardly to open the intake port 34.

With the present invention, as described above, since the valve is made of a ceramic material, it is light and can operate with a good response. Furthermore, the movable member on the upper end of the valve stem of the valve has a frustoconical flange portion on its upper end, and the fixed member disposed above the movable member in confronting relation thereto has a recessed portion complementary to the frustoconical flange portion of the movable member. This arrangement allows a sufficient magnetic path cross-sectional area to be maintained without substantially increasing the size of the movable member even if the valve is made of a nonmagnetic ceramic material.

Although a certain preferred embodiment has been shown and described, it should be understood that many changes and modifications may be made therein without departing from the scope of the appended claims.

What is claimed is:

1. An electromagnetically operated valve assembly for selectively opening and closing a port communicating with a cylinder in an internal combustion engine, comprising:

a valve made of a ceramic material, for selectively opening and closing the port, said valve including a stem;

a movable member mounted on an end of said stem and having a frustoconical flange portion on an end thereof, said movable member being made of a magnetic material;

a first coil disposed around said movable member;

a fixed member disposed in confronting relation to said movable member and having a recessed portion complementary in shape to said frustoconical flange portion, said fixed member being made of a magnetic material; and a second coil disposed around said fixed member.

2. An electromagnetically operated valve assembly according to claim 1, wherein said frustoconical flange portion has a tapered surface composed of a plurality of successive steps, and said recessed portion has a tapered surface composed of a plurality of successive steps complementary in shape to said successive steps of the frustoconical flange portion.

* * * * *